US010738555B2

(12) United States Patent
Cummins

(10) Patent No.: US 10,738,555 B2
(45) Date of Patent: Aug. 11, 2020

(54) CHOKE MANIFOLD FOR DRILLING AND PRODUCING A SURFACE WELLBORE

(71) Applicant: Schlumberger Technology Corporation, Sugar Land, TX (US)

(72) Inventor: Ray Cummins, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 27 days.

(21) Appl. No.: 15/652,553

(22) Filed: Jul. 18, 2017

(65) Prior Publication Data

US 2019/0024470 A1 Jan. 24, 2019

(51) Int. Cl.

| | |
|---|---|
| ***E21B 21/01*** | (2006.01) |
| ***E21B 34/02*** | (2006.01) |
| ***E21B 33/03*** | (2006.01) |
| ***E21B 33/038*** | (2006.01) |
| ***E21B 23/04*** | (2006.01) |
| ***E21B 33/06*** | (2006.01) |

(52) U.S. Cl.

CPC ..... *E21B 33/03* (2013.01); *E21B 21/01* (2013.01); *E21B 23/04* (2013.01); *E21B 33/038* (2013.01); *E21B 33/06* (2013.01); *E21B 34/02* (2013.01)

(58) Field of Classification Search

CPC ..... E21B 2021/007; E21B 21/01; E21B 34/02

See application file for complete search history.

(56) References Cited

U.S. PATENT DOCUMENTS

| | | | | |
|---|---|---|---|---|
| 3,068,896 | A * | 12/1962 | Grove | E21B 43/14 137/594 |
| 3,103,234 | A * | 9/1963 | Washburn | F16L 55/052 138/30 |
| 3,708,207 | A * | 1/1973 | Steele | B65G 53/58 137/853 |
| 2012/0255777 | A1* | 10/2012 | Bernard | E21B 21/08 175/25 |
| 2014/0076577 | A1* | 3/2014 | Shampine | E21B 43/12 166/373 |
| 2017/0130706 | A1 | 5/2017 | Plaza et al. | |

FOREIGN PATENT DOCUMENTS

| | | | |
|---|---|---|---|
| CN | 205778674 | U | 12/2016 |
| KR | 10-2013-0125250 | A | 11/2013 |
| WO | 2017007452 | A1 | 1/2017 |

* cited by examiner

*Primary Examiner* — Cathleen R Hutchins
(74) *Attorney, Agent, or Firm* — Rachel E. Greene

(57) ABSTRACT

A choke manifold and methods for assembling the same are provided. The choke manifold can include a choke line, a first pulsation dampener in fluid communication with the choke line, and a first choke valve in fluid communication with the first pulsation dampener. The first pulsation dampener is downstream of the choke line and up stream of the first choke valve.

15 Claims, 11 Drawing Sheets

FIG. 3
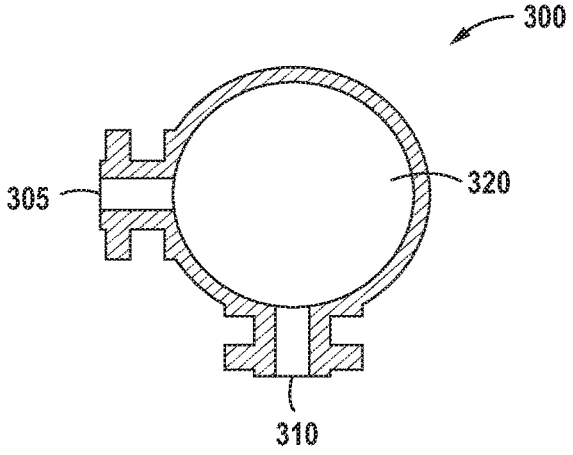
FIG. 4
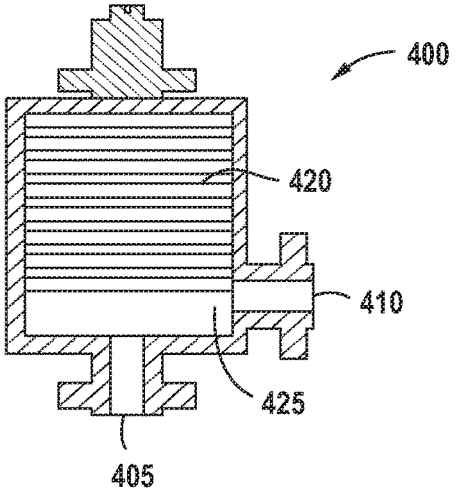
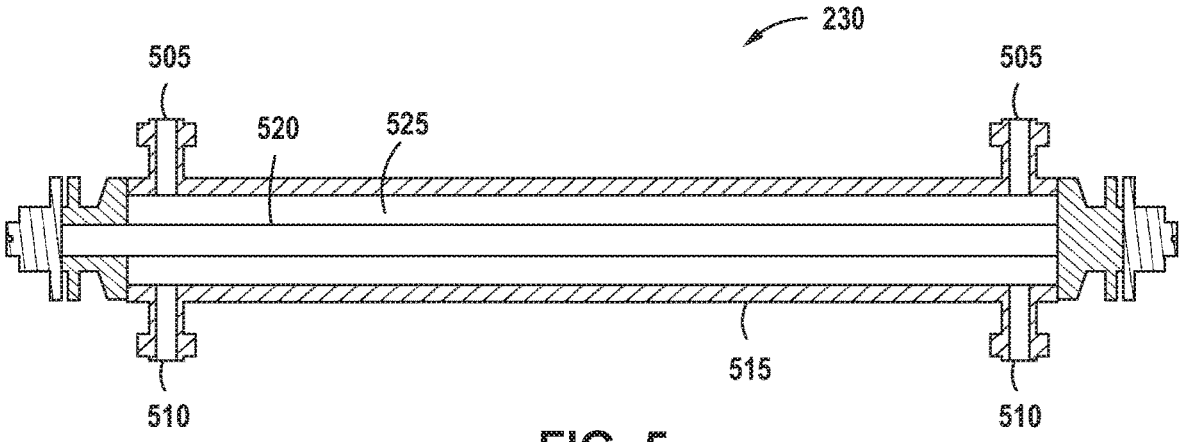
FIG. 5

CHOKE MANIFOLD FOR DRILLING AND PRODUCING A SURFACE WELLBORE

BACKGROUND

Field

Embodiments described generally relate to a choke manifold for drilling and producing a surface wellbore as well as methods for assembling same.

Description of the Related Art

In oil and gas production, a wellhead is a structural and pressure-containing interface to a well for the drilling and production equipment. A wellhead is typically welded onto the first string of casing, which has been cemented in place during drilling operations, to form an integral structure of the well. A valve stack that includes one or more isolation valves, commonly known as a xmas tree or Christmas tree, is installed on top of the wellhead to control the surface pressure. This stack can further include choke and kill equipment to control the flow of well fluids during production. A typical wellhead system includes a casing head, casing spools, casing hangers, packoffs (isolation) seals, test plugs, mudline suspension systems, tubing heads, tubing hangers, and a tubing head adapter.

A kill line typically has a valve and tubing/piping connected between one or more mud pumps or other fluid delivery pumps and a connection below a blowout preventer to facilitate the pumping of fluid into the well when a well blowout preventer is closed. A choke line typically has a line leading from an outlet on the blowout preventer to a back-pressure choke and associated manifold.

During well drilling and production preparations, the system might take a kick from a formation that had a higher pressure than the hydrostatic pressure of the circulating drilling mud. When this occurs, the pressure from the formation flows into the wellbore and up the annulus until it reaches the surface. The operator reacts by closing a blowout preventer (BOP) and diverting the fluid through the choke line to a choke valve or choke manifold where the high pressure wellbore fluid passes through a choke to reduce pressure, typically at or near atmospheric pressure. If necessary, a higher weight mud is pumped down the kill line to stifle the influx until control of the wellbore is regained and drilling operations can resume. When the high pressure flows through the choke line into the choke manifold, the high pressure spike into the choke manifold can cause vibrations that can damage and reduce the life of the components of the manifold and any equipment further downstream of the manifold.

There is a need for a choke manifold and methods for using same that can mitigate the high pressure spikes introduced into the choke manifold.

SUMMARY

A choke manifold and methods for assembling the same are provided. The choke manifold can include a choke line, a first pulsation dampener in fluid communication with the choke line, and a first choke valve in fluid communication with the first pulsation dampener. The first pulsation dampener is downstream of the choke line and up stream of the first choke valve.

A method for assembling a wellbore stack using the choke manifold includes landing a wellhead stack on a drilling flange. The wellhead stack having blow out preventers, a kill line hub secured to and in fluid communications with a spool located below a first blowout preventer, a choke line hub secured to and in fluid communications with a spool located between a second blowout preventer and the first blow out preventer, and a choke line in fluid communication with a choke manifold. The choke manifold includes a pulsation dampener and a kill line. Both the kill line and choke line can each have a quick connect collet connector such that the kill line collet connector can be landed on the kill line and the choke line collet connector on the choke line hub.

A wellhead stack is also provided. The stack can include two or more blow out preventers, a kill line hub secured to and in fluid communications with a spool located below a first blowout preventer, a choke line hub secured to and in fluid communications with a spool located between a second blowout preventer and the first blow out preventer. A choke line can be in fluid communication with a choke manifold that includes a pulsation dampener, and a kill line.

BRIEF DESCRIPTION OF THE DRAWINGS

FIG. 3 depicts a section view of a flow through pulsation dampener, according to one or more embodiments provided herein.

FIG. 4 depicts a section view of a pulsation dampener including internal metal bellows, according to one or more embodiments provided herein.

FIG. 5 depicts a section view of a buffer chamber including a de-surge pipe, according to one or more embodiments provided herein.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figures 1, 2:
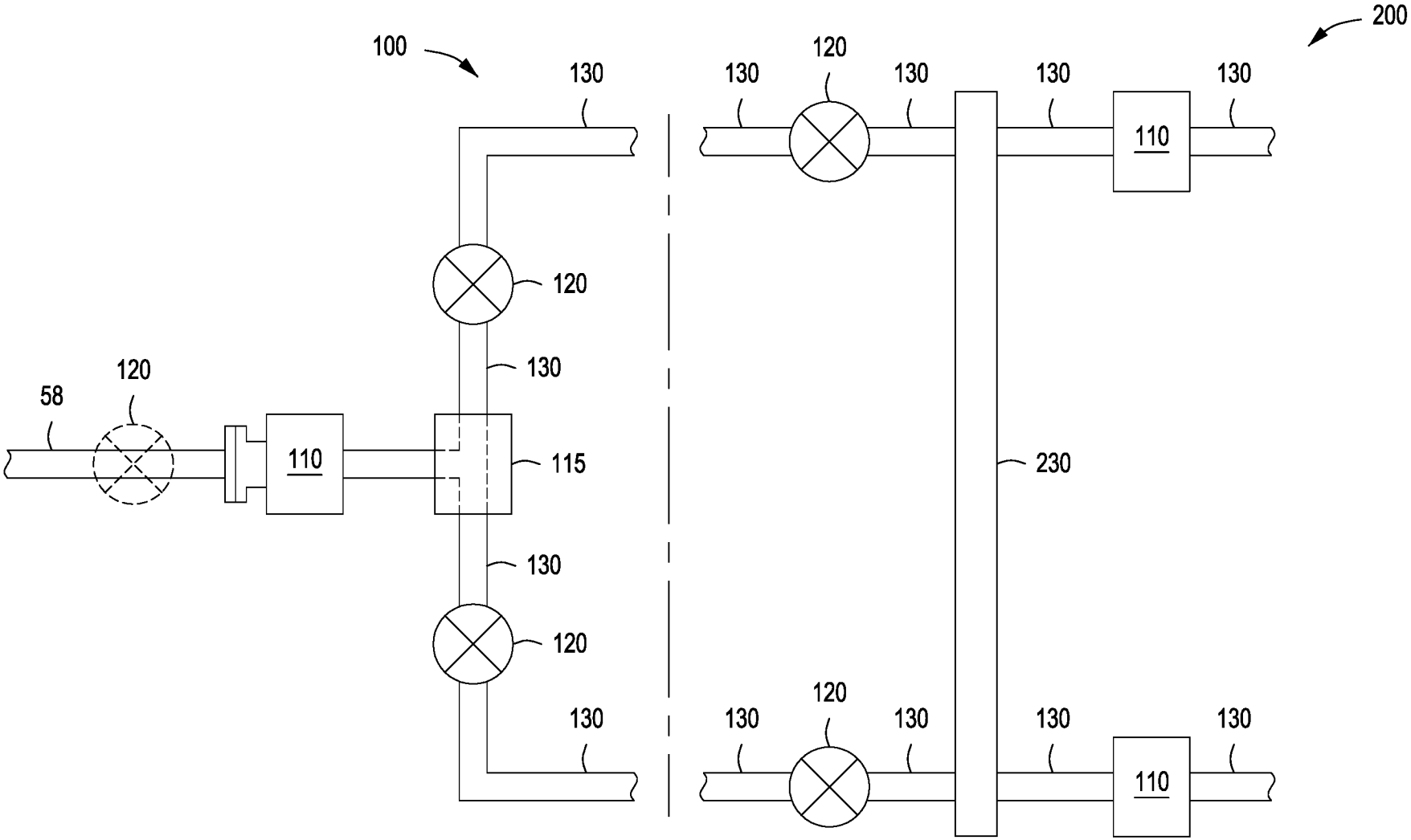
FIG. 1 depicts a portion of an illustrative choke manifold assembly with a pulsation dampener, according to one or more embodiments provided herein.
FIG. 2 depicts a portion of an illustrative choke manifold assembly with a pulsation dampener and a buffer chamber, according to one or more embodiment provided herein.

FIG. 1 depicts a portion of an illustrative choke manifold assembly with a pulsation dampener 110, according to one or more embodiments. The choke manifold 100 can include any number of choke valves 120 and pulsation dampeners 110. The choke manifold 100 can include any other associated components and accessories conventionally used in choke manifolds. For example, the choke manifold 100 can include a choke line 58, one or more pulsation dampeners 110 (one is shown), and one or more choke valves 120 (two are shown), secured to and in fluid communications with each other via one or more tubular sections or pipes 130. One or more diverters 115 (one is shown) can be incorporated to allow two or more fluid paths (two paths are shown) through the choke valves 120. The pulsation dampener 110 can be secured directly to the choke line 58, as shown, or alternatively can be plumbed immediately downstream of one or more choke valves 120 (one is depicted in dashed lines).

FIG. 2 depicts a portion of an illustrative choke manifold assembly with a pulsation dampener 110 and a buffer chamber 230, according to one or more embodiments. The choke manifold 200 can include any number of valves, pulsation dampeners 110. The choke manifold 200 can include any other associated components and accessories conventionally used in choke manifolds. For example, the choke manifold 200 can include one or more pulsation dampeners 110 (two are shown), one or more buffer chambers (one is shown 230), and one or more choke valves 120 (two are shown), secured to and in fluid communications with each other via one or more tubular sections or pipes 130. The choke manifold 100 depicted in FIG. 1 and be secured to and in fluid communications with the choke manifold 200 depicted in FIG. 2.

FIG. 3 depicts a section view of a flow through pulsation dampener 300, according to one or more embodiments. FIG. 4 depicts a section view of a pulsation dampener 400 including internal metal bellows 420, according to one or more embodiments provided herein. The pulsation dampeners 300 and 400 can each be an accumulator that can absorb system shocks while minimizing pulsations, pipe vibration, water hammering and pressure fluctuations.

The flow through pulsation dampener 300 can utilize drilling fluid to dampen pulses introduced into an inlet 305. For example, when fluid is passing through the flow through pulsation dampener 300 and an energy pulse is introduced into the inlet 305, the volume of drilling fluid present in the chamber 320 can absorb and disperse the pulses within the drilling fluid and to the outer walls of the pulsation dampener 300 so that less pulse energy can travel with the drilling fluid through the outlet 310.

The pulsation dampener 400 can include one or more metal bellows 420. The metal bellows 420 can be made of any suitable material that allows it to compress and expand. The metal bellows 420 can be filled with a gas, such as nitrogen to allow the bellow to be compressed and/or can expand. As the bellows 420 expands and contracts it is able to absorb energy pulses, based on a fluctuating pressure within an accumulation chamber 425. For example, when fluid is passing through the pulsation dampener 400 and an energy pulse is introduced into the inlet 405, the bellows 420 can compress, compressing the gas filled volume inside the bellows 420, and absorb and disperse the pulses so that less pulse energy can travel with the drilling fluid through the outlet 410.

FIG. 5 depicts a section view of a buffer chamber 230 including a de-surge pipe 520, according to one or more embodiments. The buffer chamber 230 can be an accumulator that can absorb system shocks while minimizing pulsations, pipe vibration, water hammering and pressure fluctuations. The de-surge pipe 520 can be a flexible and/or compressible pipe secured within an inner volume 525 within an annular wall 515 of the buffer chamber 230. The de-surg pipe 520 can be made from the same materials as the piping and valves in the manifold 100, 200, including low carbon alloy steels, plastics such as UHMW, PEEK, thermoplastics, polycarbonates and any other suitable thermoplastic resins. Fluid can flow through the inner volume 525 and over and around the de-surge pipe 520. The buffer chamber 230 can dampen energy pulses introduced into one or more inlets 505 (two are shown). For example, when fluid is passing through the inner volume 525 and an energy pulse is introduced into at least one of the inlets 505, the de-surge pipe 520 can absorb at least some of the energy in the pulses by flexing and/or compressing along its length so that less pulse energy can travel with the drilling fluid through the outlets 510.

Figure 6:
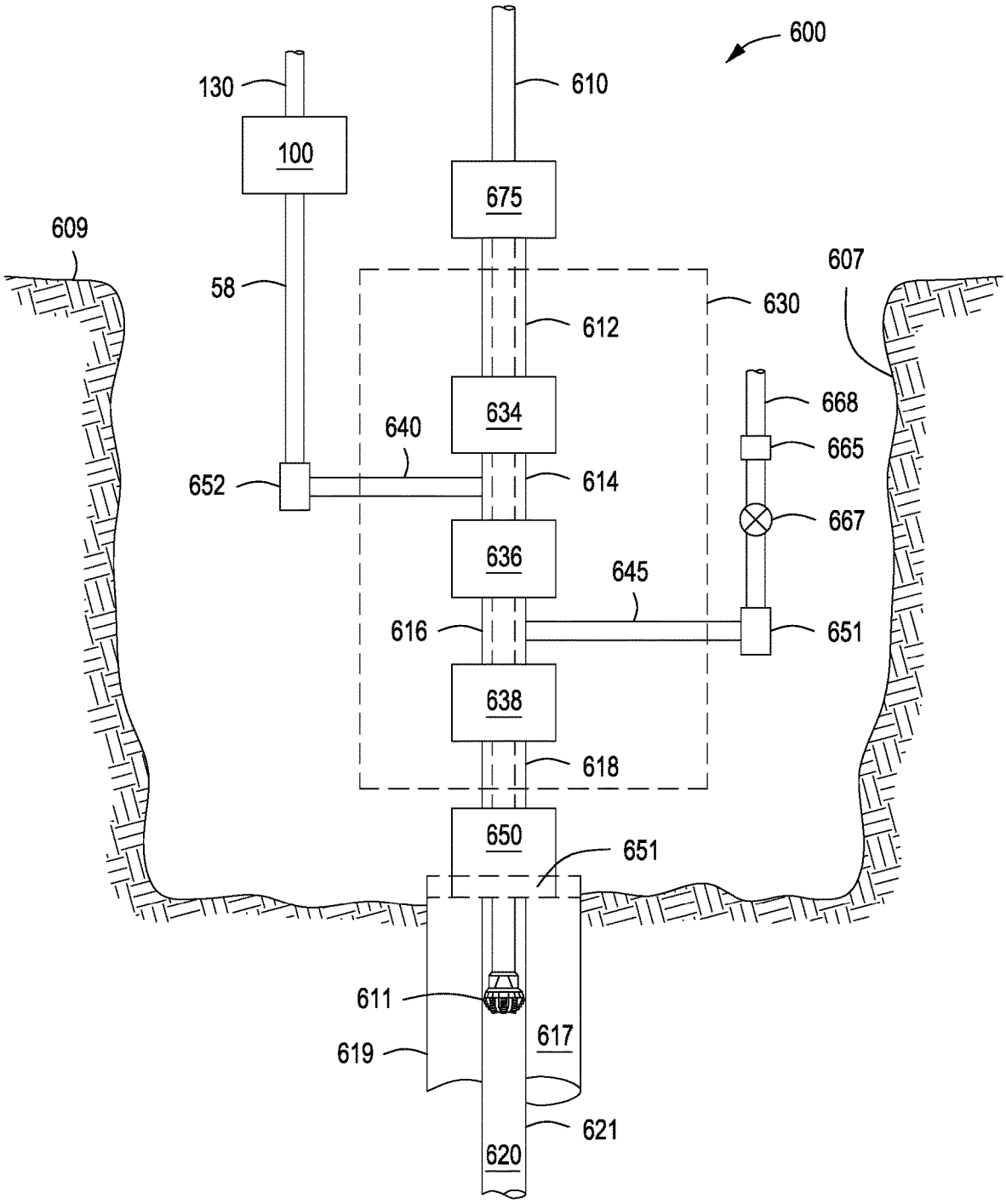
FIG. 6 depicts an illustrative surface wellbore assembly, according to one or more embodiments provided herein.

FIG. 6 depicts an illustrative surface wellbore assembly 600 for drilling and production, according to one or more embodiments. The wellbore assembly 600 can include any number of valves, blowout preventers, casing spools, hangers, seals, studs, nuts, ring gaskets, and other associated components and accessories conventionally used to provide a structural and pressure-containing interface for drilling and production equipment. For example, the wellbore assembly 600 can include a blowout preventer stack (BOP stack) 630 that can include one or more blowout preventers (three are shown 634, 636, 638) secured to and in fluid communications with each other via one or more tubular spools 612, 614, 616.

A choke line hub 640 can be connected to and in fluid communication with the BOP stack 630. For example, the choke line hub 640 can be connected at an upper or second spool 614 located between the second and third blowout preventers 636, 634. A quick connect collet connecter 652 can be used to connect the choke line 58 to the choke line hub 640, or any suitable flange or hub connection that can be bolted together can be used. The choke line 58 can be connected to the choke manifold 100.

A kill line hub 645 can be connected to and in fluid communication with the BOP stack 630. For example, the kill line hub 640 can be connected at a lower or first spool 616 located between the first and second blowout preventers 638, 636. A kill line 668 and kill valve 667 can be installed on and in fluid communication with the kill line hub 645 via a quick connect collet connector 651, or any suitable flange or hub connection that can be bolted together can be used. The kill line 668 can be connected to the kill valve 667 via a flange 665.

Figure 13:
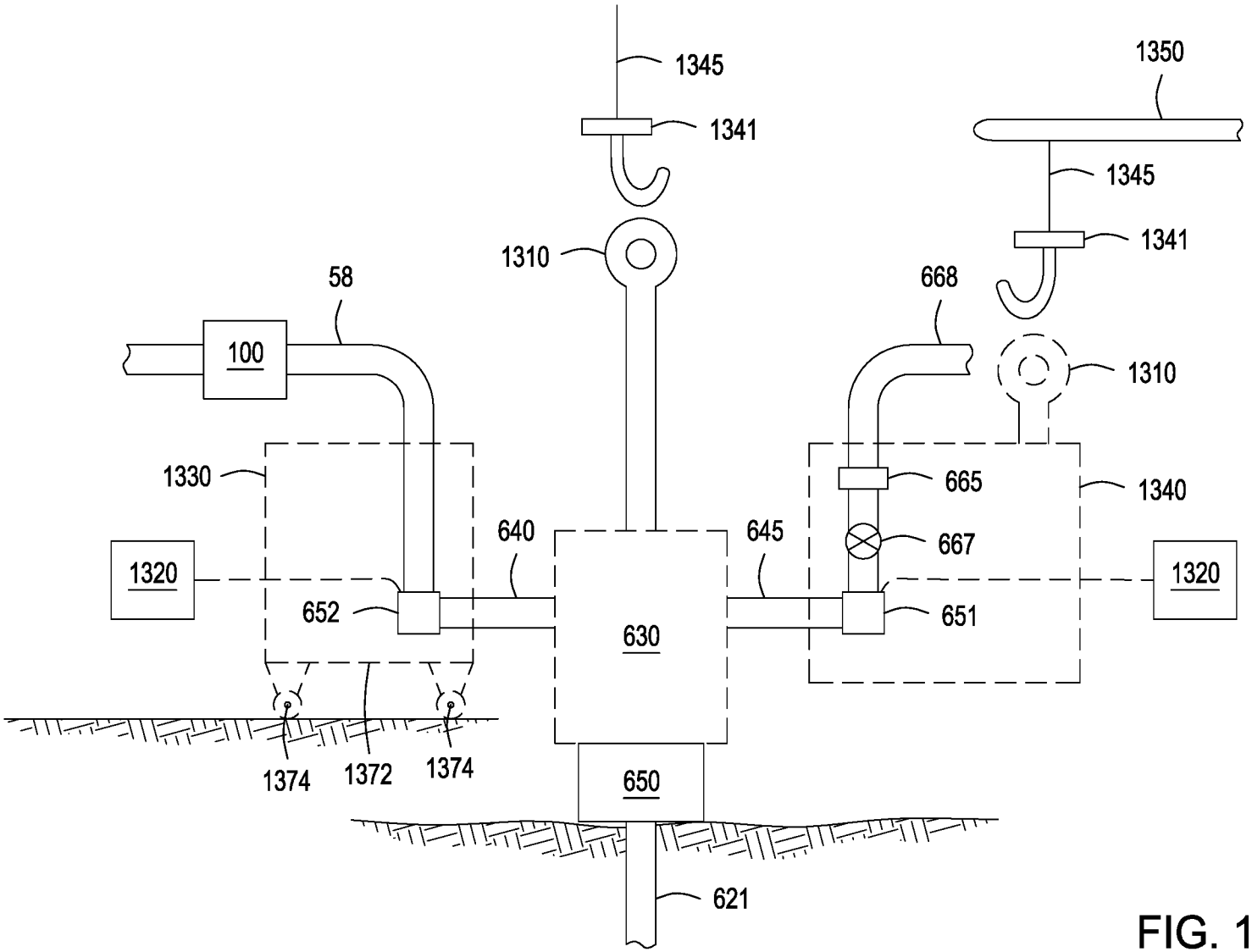
FIG. 13 depicts the illustrative wellbore stack secured to a wellbore during well drilling, well operations, or well workover, according to one or more embodiments provided herein.

For on-land wellbores, the wellbore assembly 600 can be located at least partially within a drilling cellar 607 that is excavated or dug below the surface or ground 609. The drilling cellar 607 can be lined with wood, cement, pipe, or other materials. The depth of the cellar 607 can be excavated such that a master valve on a Christmas tree is accessible from ground level. The wellbore assembly 600 also can be located directly on the surface 609 without the need for a drilling cellar 607. FIG. 13 depicts this configuration.

If a drilling cellar 607 is used, a conductor pipe borehole 619 can be drilled below the drilling cellar 607 and a conductor pipe 617 can be installed within the conductor pipe borehole 619 and cemented in. A drilling flange 651 can be installed on the surface side of the conductor pipe 617. The BOP stack 630 can be installed directly on the drilling flange 651.

A wellbore 621 can be drilled within and below the conductor pipe borehole 619 by introducing a drill string 610 and a drill head 611 into the conductor pipe borehole 619, and rotating the drill string 610 and drill head 611 with a rotary table 675, drilling into the ground 609 within the drilling cellar 607 until a desired depth is reached. A casing 620 can be installed within the wellbore 621. The casing 620 can be cemented in, and plugged at the bottom. The casing 620 can be a pipe installed within the borehole 619 and can prevent contamination of fresh water well zones along the borehole 619, prevent unstable formations from caving in, isolate different zones within the borehole 619, seal off high-pressure zones from the surface, prevent fluid loss into or contamination of production zones within the borehole 619, and provide a smooth internal bore for installing production equipment.

The BOP stack 630 can be removed from the drilling flange 651 and a casing head housing 650 can be installed on the casing 620. The casing head housing 650 can be an adapter between the casing 620 and either the BOP stack 630 during drilling or the Christmas tree, not shown, after well completion. This adapter can be threaded or welded onto the casing 620 and may have a flanged or clamped connection to match the BOP stack 630 connection configuration. The BOP stack 630 can be installed on a casing spool 618 installed on the casing head housing 650.

The choke line 58 and the kill line 668 can be installed on the BOP stack 630 by landing the kill line collet connector 651 on the kill line hub 645, and landing the choke line collet connector 652 on the kill line hub 640. Each collet connector 651, 652 can then be activated to bring a throughbore in the choke line hub 640 and the kill line hub 645 into sealing engagement with the through bore of each collet connector such that the choke manifold 100 and the kill line valve 667 can each separately control fluid flow through the choke line hub 640 and the kill line hub 645, respectively.

Each blowout preventer 634, 636, 638 can be the same of can differing from one another. For example, each BOP can be an annular type, a shear-blind type, or a pipe preventer type. The annular blowout preventer type can include a large valve used to control wellbore fluids. In this blowout preventer type, the sealing element can resemble a large rubber doughnut that is mechanically squeezed inward to seal on either casing 620 (drill collar, drillpipe, casing, or tubing) or the wellbore 621. The blind shear ram blowout preventer type can include a closing element fitted with hardened tool steel blades designed to cut the casing 620 when the blowout preventer is closed, and then fully close to provide isolation or sealing of the wellbore. The pipe ram blowout preventer type can include a sealing element with a half-circle hole on the edge (to mate with another horizontally opposed pipe ram) sized to fit around casings such as casing 620.

Considering the choke line 58 in more detail, the choke manifold 100 can be secured and in fluid communications with the choke line hub 640 via a choke line connector 652 where choke line connector 652 is configured to connect to the choke line hub 640.

Considering the kill line 668 in more detail, a kill valve 667 can be secured to the kill line hub 645 via kill line connector 651 where kill line connector 651 is configured to connect to the kill line hub 645. The kill line 668 can be secured to the kill valve 667 via a flange 665. The choke line 58 and kill line 668 can be rigid tubing or pipe, semi-rigid tubing or pipe, and/or flexible tubing or pipe. The connectors 651 and 652 can be any combination of collect connectors, dog in window style connectors, clamp style connector or other known connectors and can be hydraulically actuated, manually actuated, or electrically operated. The entire assembly of BOP stack 630, with kill valve 667 and choke manifold 100 can be reconfigured to support various well drilling and production activities.

During drilling operations, drilling mud can be pumped into the borehole 619 through the drill string 610 to cool the drill head 611 and to control formation pressures within the borehole 619. Formation pressures within the borehole 619 can be measured to determine if the formation pressure exceeds the pressure from the drilling mud. If the formation pressure exceeds the mud pressure, drilling can be discontinued, at least one blow out preventer can be closed, and the choke manifold 100 can be adjusted to stabilize the downhole pressure. Various drilling mud densities can be introduced into the borehole 619 through the kill line 668 to stabilize the downhole pressure and to flow the pressure differential out of the borehole 619 through the choke valve. Once the pressure differential has been stabilized, drilling can be restarted.

Figure 7:
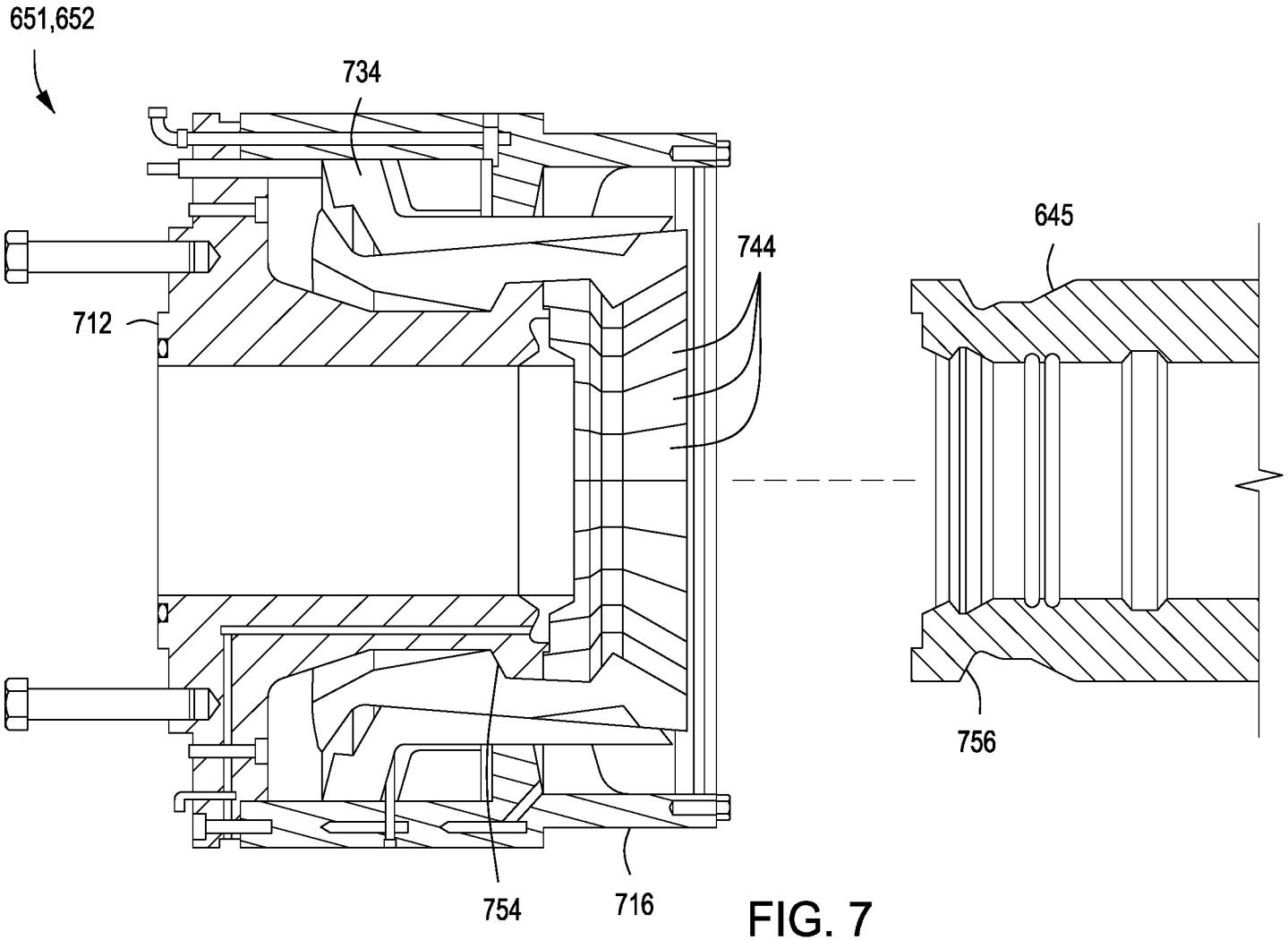
FIG. 7 depicts an illustrative partial section view of the kill line connector and kill line hub that can be used in both the choke line and the kill line to provide a quick and easy connect/disconnect with the wellbore stack assembly, according to one or more embodiments provided herein.

FIG. 7 depicts an illustrative partial section view of the kill line connector 651 and kill line hub 645 or choke line hub 640 that can be used in both the choke line 58 and the kill line 668 to provide a quick and easy connect/disconnect with the wellbore assembly 600, according to one or more embodiments. Connectors 651 and 652 can be a hydraulically actuated collet connector. The collet connector can include a body 716, latching fingers 744, and an actuator ring or operating piston 734. The collet connector can secure in fluid communication a first tubular member 712 to a second tubular member or hub 645 by introducing mechanical forces to a tapered shoulder 754 and a tapered shoulder or hub profile 756.

Figure 8:
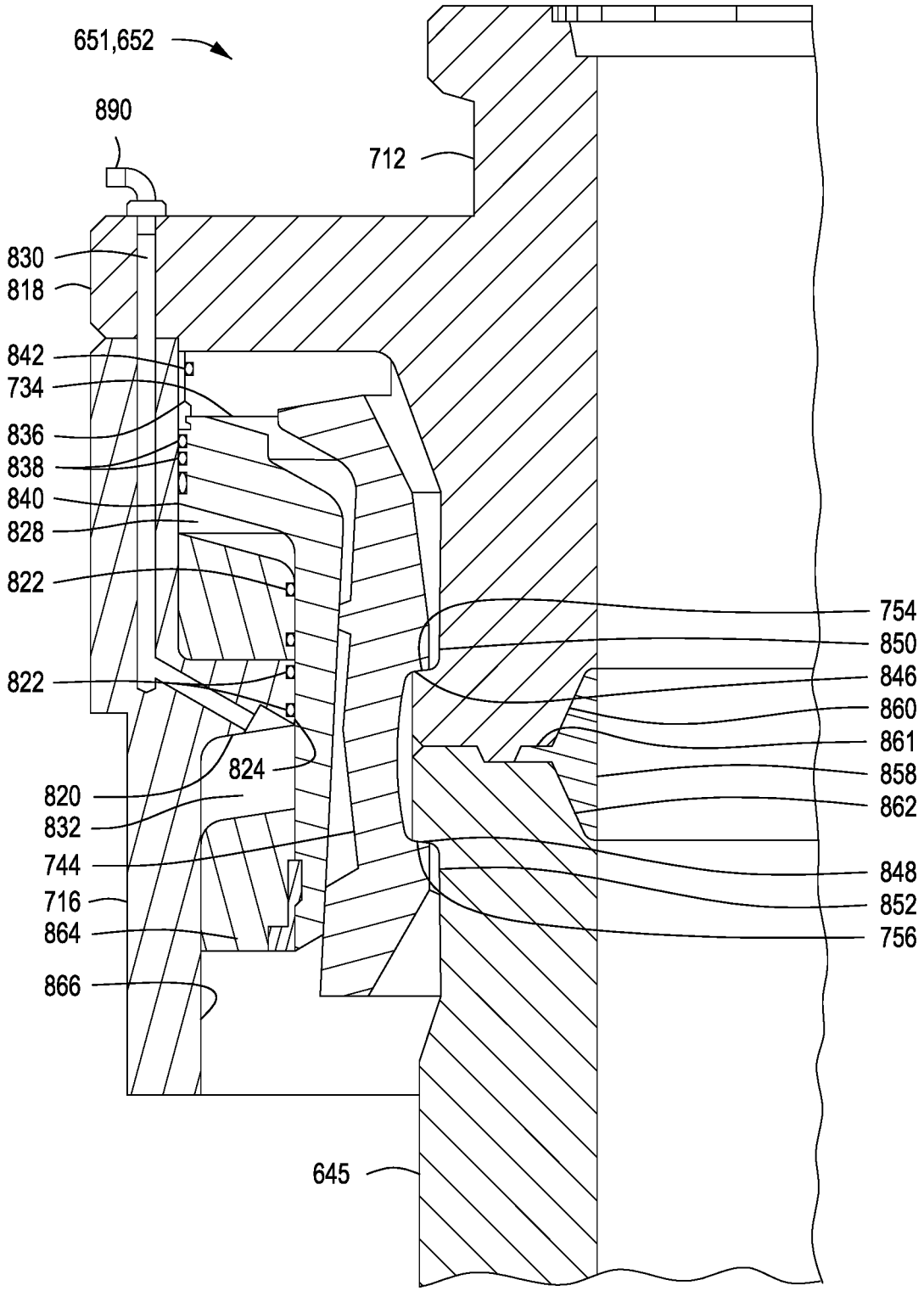
FIG. 8 depicts a section view of an illustrative collet connector in its locking position, according to one or more embodiments provided herein.
Figure 9:
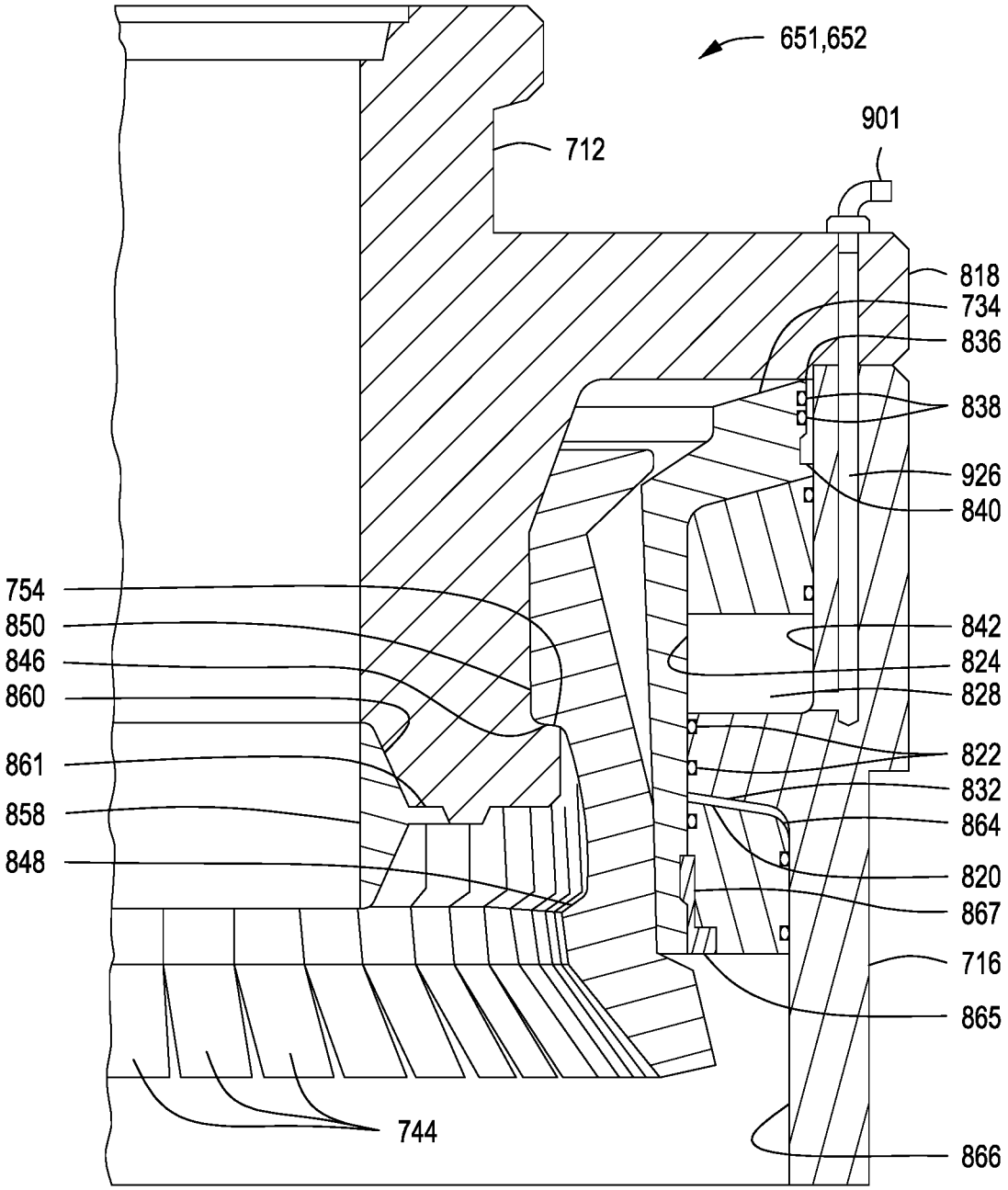
FIG. 9 depicts a section view of the illustrative collect connector in its open position, according to one or more embodiments provided herein.

FIG. 8 depicts a section view of an illustrative collet connector in its locking position, according to one or more embodiments. The illustrative connector 651, 652 can be a remotely actuated collet connector or a manually operated collet connector. As depicted, the connector 651, 652 is in its locking position joining first tubular member 712 to the hub 645. FIG. 9 depicts a section view of the illustrative collect connector in its open position, according to one or more embodiments. The connector 651, 652 is depicted mounted on the first tubular member 712 but with the hub 645 re-moved.

The connector 651, 652 can include housing 716 secured to flange 818 of first tubular member 712 and extending axially in surrounding relationship over the position into which the hub 645 is positioned for the connection. Upper and lower annular operating cylinders 828 and 832 are bounded by annular lip 820 of housing 716 which extends inwardly from housing 716 and includes seals 822, such as O rings, positioned in grooves on the inner surface 824 of lip 820. Passage 926 extends through flange 818 and through housing 716 and opens into upper cylinder 828 above lip 820 such that a fluid can be introduced to the upper cylinder 828 through an open port 901. Passage 830 extends through flange 818 and through housing 716 and opens into lower cylinder 832 on the opposite side of lip 820 from cylinder 828 such that a fluid can be introduced to the lower cylinder 832 through a close port 890. Actuator ring 734 can be positioned within housing 716 and includes flange 836 extending outwardly with seals 838 in its outer surface 840 to seal against the upper inner surface 842 of housing 716.

Latching fingers or segments 744 are positioned within actuator ring 734 and are closely spaced together. Latching fingers 744 include shoulders 846 and 848 on projections 850 and 852 and are adapted to engage and secure tapered shoulders 754 and 756 on first tubular member 712 and hub 645.

Seal ring 858 is positioned between the inner ends of first tubular member 712 and hub 645 and seals against the inner tapered surfaces 860 and 862 of member 712 and hub 645, respectively. Seal ring or gasket 858 includes outer diameter enlargement 861 which is used to secure seal ring 858 to first tubular member 712 by suitable means such as bolting, welding, epoxy, or other known means (not shown).

Cylinder head ring 864 is secured to the exterior surface of actuator ring 734 at its lower outer end; is suitably attached thereto by retainer 865 and split ring 867; and is sealed to the lower interior surface 866 of housing 716 and to actuator ring 734 as shown. Retainer ring 865 is secured by bolting (not shown) to cylinder head ring 864.

In FIG. 8 the tubular member 712 and hub 645 can be connected to one another in sealed locking engagement by introducing a fluid into passage 926 through close port 890 to actuate the actuator ring 734 over the fingers 744 to move fingers 744 into tight clamping engagement with shoulders 754 and 756 and to sealingly engage seal ring 858 between surfaces 860 and 862 of member 712 and hub 645. After connection, the fluid in passage 926 can be vented. Referring to FIGS. 8 and 9, the tubular member 712 and hub 645 can be disconnected from one another by introducing a fluid into passage 926 through open port 901 to actuate the actuator ring 734 in the direction opposite the closing direction so as to release the fingers 744 from tight clamping engagement with shoulders 754 and 756. The connector 651, 652 can then be removed from hub 645.

Figure 10:
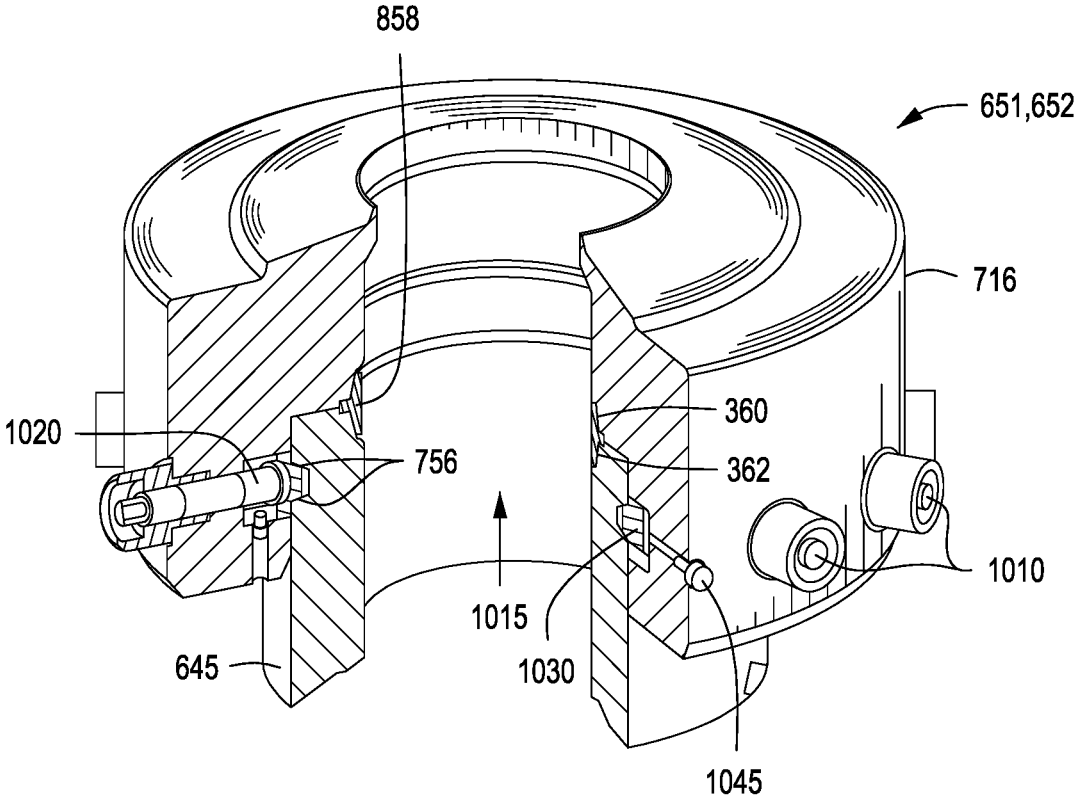
FIG. 10 depicts a section view of an illustrative dog in window type connector in its locking position, according to one or more embodiments provided herein.

FIG. 10 depicts a section view of an illustrative dog in window type connector in its locking position, according to one or more embodiments. As depicted, the connector 651, 652 is in its locking position joining housing 716 to hub 645. Housing 716 can contain threaded shafts or jack screws 1020 with external interfaces 1010 configured to accept tooling, not shown, for rotating the threaded shafts 1020. The threaded shafts can be distributed approximately perpendicular to the axis of a thru bore 1015 and about the housing 716. The threaded shafts 1020 can engage one or more dogs, collets, or lock-ring segments 1030 such that when the threaded shafts 1020 are rotated the lock-ring segments 1030 move in concert with the threaded shafts 1020. One or more lubricant injection ports 1045 can be distributed about the housing 716 and configured to deliver lubricant to the threaded shafts 1020 and other moving parts as needed. The housing 716 and the hub 645 can be connected to one another in sealed locking engagement by the actuation of the threaded shafts 1020 such that the lock-ring segments 1030 are engaged with the hub 645 into tight clamping engagement with shoulder 756 and to sealingly engage seal ring 858 between surfaces 860 and 862 of housing 716 and hub 645.

Figure 11:
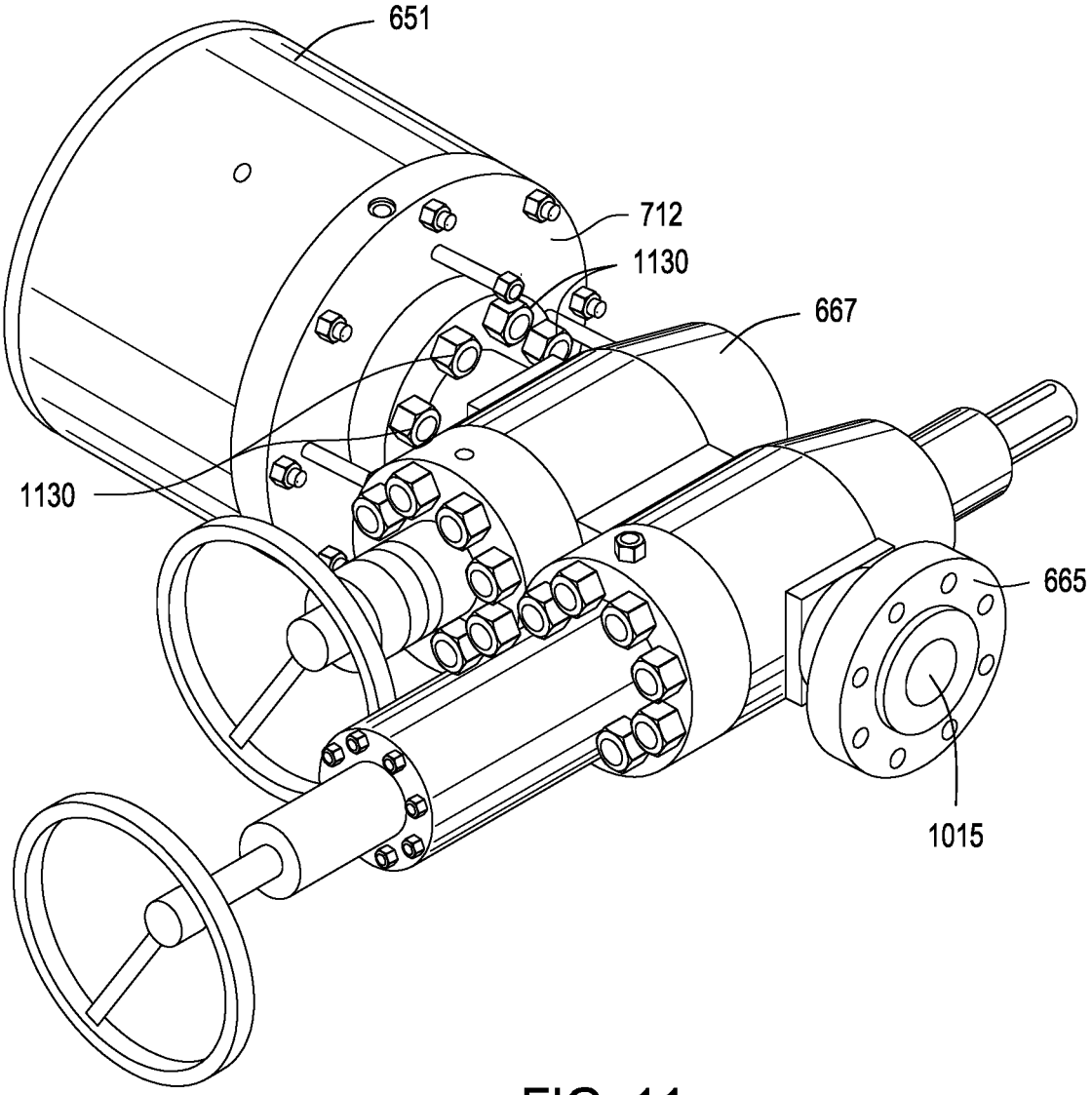
FIG. 11 depicts a three-dimensional view of an illustrative connector secured to an illustrative valve, according to one or more embodiments provided herein.

FIG. 11 depicts a three-dimensional view of an illustrative connector secured to an illustrative valve, according to one or more embodiments. As depicted, the illustrative valve can be the kill valve 667 and can be secured to the kill line connector 651 via bolts 1130 prior to installation on a kill hub, not shown. The illustrative connector can be choke line connector 652 secured a choke manifold 100 depicted in FIG. 1.

Figure 12:
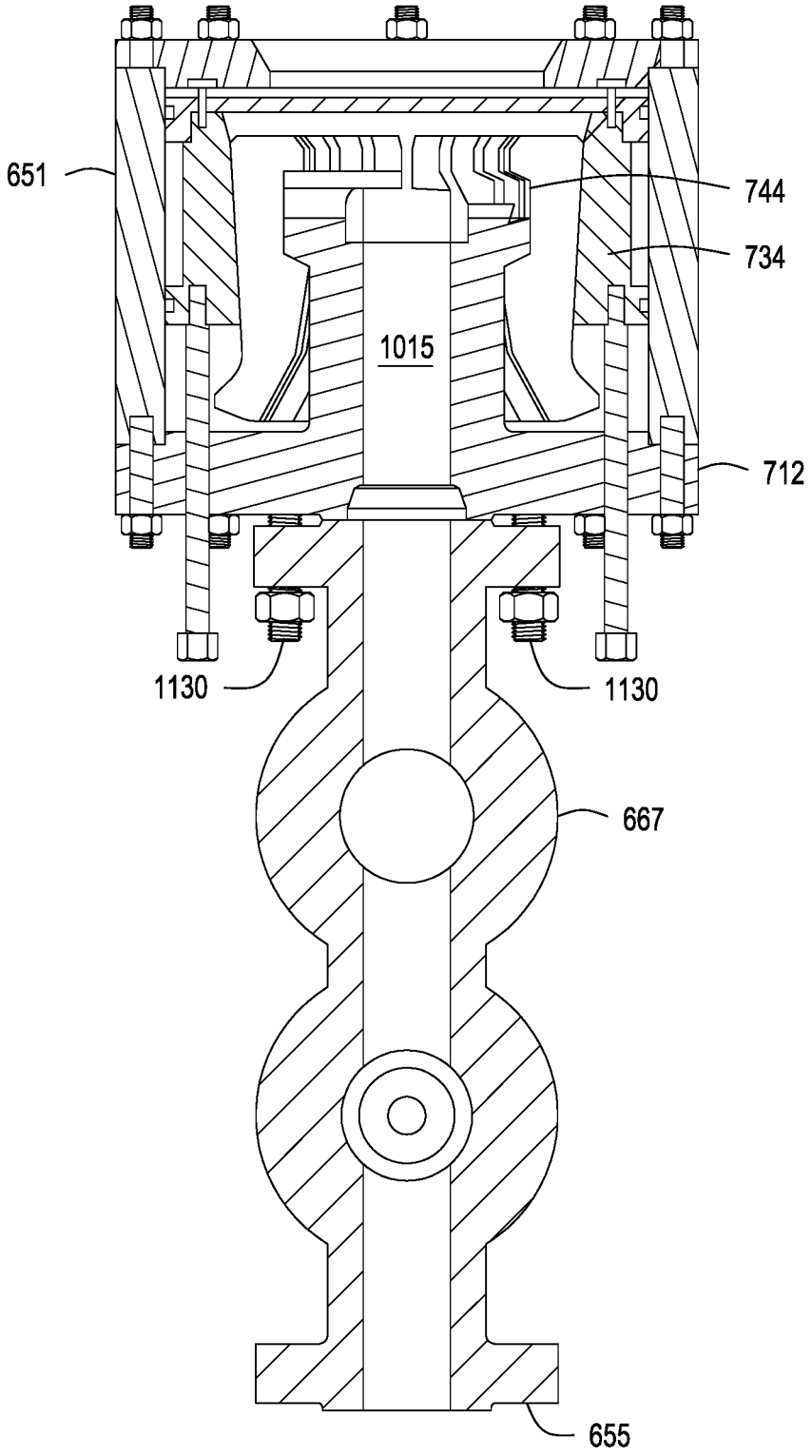
FIG. 12 depicts a section view of the illustrative connector secured to an illustrative valve, according to one or more embodiments provided herein.

FIG. 12 depicts a section view of the illustrative connector secured to an illustrative valve, according to one or more embodiments. As depicted, the kill valve 667 can be secured to the member 712 on kill line connector 651 via bolts 1130. The bolts 1130 can be distributed about the kill line connector 651 such that by tightening the bolts 1130, the kill valve 667 can be brought into tight clamping engagement with the kill line connector 651 to sealingly engage the through bore 1015 of the kill valve 667 with the through bore 1015 of the kill line connector 651. The through bore 1015 can allow fluid flow through both the kill line connector 651 and the valve 667. The kill valve 667 can control fluid flow in the through bore 1015. A similar configuration can be utilized for the choke manifold 100 and connecter 652 as depicted in FIG. 1, such that the choke manifold 100 can control fluid flow in the through bores disposed within the choke manifold 100 and the choke line connector 652.

FIG. 13 depicts the illustrative wellbore stack secured to the wellbore during well drilling, well operations, or well workover, according to one or more embodiments. During well drilling, well operations, or well workover, depending on the configuration of the wellhead and casing strings, it may be necessary to nipple-down and nipple-up the BOP stack 630 as each casing string is run. To nipple-down means the process of disassembling well-control or pressure-control equipment, such as the BOP stack 630, from the wellbore 621. The disassembly can include the removal of a choke line assembly 1330 and a kill line assembly 1340 from the BOP stack 630. To nipple-up means the process of assembling the well-control equipment, the BOP stack 630, on the wellbore hub and can include reconnecting the choke line assembly 1330 and the kill line assembly 1340 to the BOP stack 630. The choke line assembly 1330 can include the choke line 58 having a through bore sealingly engaged with a through bore of the choke line connector 652 such that the choke manifold 100 can control fluid flow in the through bores. The kill valve assembly 1340 can include the Kill line 668 having a through bore sealingly engaged with a through bore of the kill valve 667 and a through bore of the kill line connector 651 such that the kill valve 667 can control fluid flow in the through bores.

During installation of the choke line assembly 1330 to choke line hub 640 located on the BOP stack 630, the choke line assembly 1330 can be structurally supported and the choke line connector 652 can be landed to the choke line hub 640. The connector 652 can be a hydraulically, electrically, or manually actuated connector. For a hydraulically operated choke line connector 652, hydraulic close pressure can be applied from a reservoir 1320 to the close port, not shown, of the hydraulically operated choke line connector 652 to sealing engage the choke line connector 652 onto the choke line hub 640. During installation of the kill line assembly 1340 to kill line hub 645 located on the BOP stack 630, the kill line assembly 1340 can be structurally supported and the kill line connector 651 can be landed to the kill line hub 645. The connector 651 can be a hydraulically, electrically, or manually actuated connector. For a hydraulically operated kill line connector 651, hydraulic close pressure can be applied from a reservoir 1320 to the close port, not shown, of the hydraulically operated kill line connector 651 to sealing engage the kill line connector 651 onto the kill line hub 645. The reservoir 1320 and any supporting equipment can be integrated with the choke line assembly 1330 and/or the kill line assembly 1340. The connectors 651 and 652 can be actuated via electric signal and/or via manual operations.

During kill and/or choke operations, the choke line assembly 1330 and the kill line assembly 1340 can be installed. Killing procedures can include circulating reservoir fluids out of the wellbore 620 or by pumping higher density mud into the wellbore 620, or both. In the case of an induced kick, where the mud density is sufficient to kill the well but the reservoir has flowed as a result of pipe movement, the kill procedure can include circulating the influx out of the wellbore 620. In the case of an underbalanced kick, the kill procedure can include circulating the influx out of the wellbore 620 and increasing the density of the mud flowing into the wellbore 620. In the case of a producing well, the kill procedure can include pumping a kill fluid into the wellbore 620 where the kill fluid has sufficient density to overcome production of formation fluid out of the wellbore 620. Influx fluids or formation fluids can be circulated out of the wellbore 620 through the choke line assembly 1330. The choke line assembly 1330 can control wellbore 620 pressure, fluid flow rate out of the wellbore 620, or downstream fluid pressure. Higher density mud and/or kill fluid can be flowed into the wellbore 620 through the kill line assembly 1340.

The kill line assembly 1340 can be structurally supported while the kill line connector 651 is actuated to disengage from the kill line hub 645 and the kill line assembly 1340 can be moved out of engagement with the kill line hub 645. In a similar fashion, the choke line assembly 1330 can be structurally supported while the choke line connector 652 is actuated to disengage from the choke line hub 640 and the choke line assembly 1330 can be moved out of engagement with the choke line hub 640. The BOP stack 630 can be moved off the wellbore 620 as needed.

Structural support of the kill line assembly 1340 and the choke line assembly 1330 can be accomplished by placing the assemblies 1340 and/or 1330 on a wheeled dolly, not shown, for transporting the assembly 1330, and a similarly outfitted assembly 1340, to and from the BOP stack 630. Structural support of the choke line assembly 1330 and the kill line assembly 1340 can be accomplished by installing either assembly in a housing, not shown. The housing can be placed on the wheeled dolly or can include a base 1372 having wheels 1374 installed thereunder for transporting the assembly 1330, and a similarly outfitted assembly 1340 not shown, to and from the BOP stack 630. The wheels 1374 can be put in motion by motors, not shown. The housing can include a lifting attachment 1310 for attaching a lifting interface 1341 for lifting and/or moving the assembly 1340, and a similarly outfitted assembly 1330 not shown, to and from the BOP stack 630. The lifting interface 1341 can be a hook, eye ring, or any attachment device that can be attached to the lifting attachment 1310. The lifting interface 1341 can include a lifting line 1345 and a swing arm or crane 1350. The lifting interface 1341 and the lifting line 1345 can be combined with or replaced by any combination of hooks, chains, wires, cables, and/or straps capable of supporting and/or lifting and/or moving the assemblies 1330 and/or 1340 to and from the BOP stack 630. The lifting interface 1341 and the lifting line 1345 can be used to support and/or lift and/or move at least a portion of the BOP stack 630. A control system, not shown, can be integrated with assemblies 1330 and 1340 for performing autonomous removal and installation operations of the assemblies 1330 and 1340.

Figure 14:
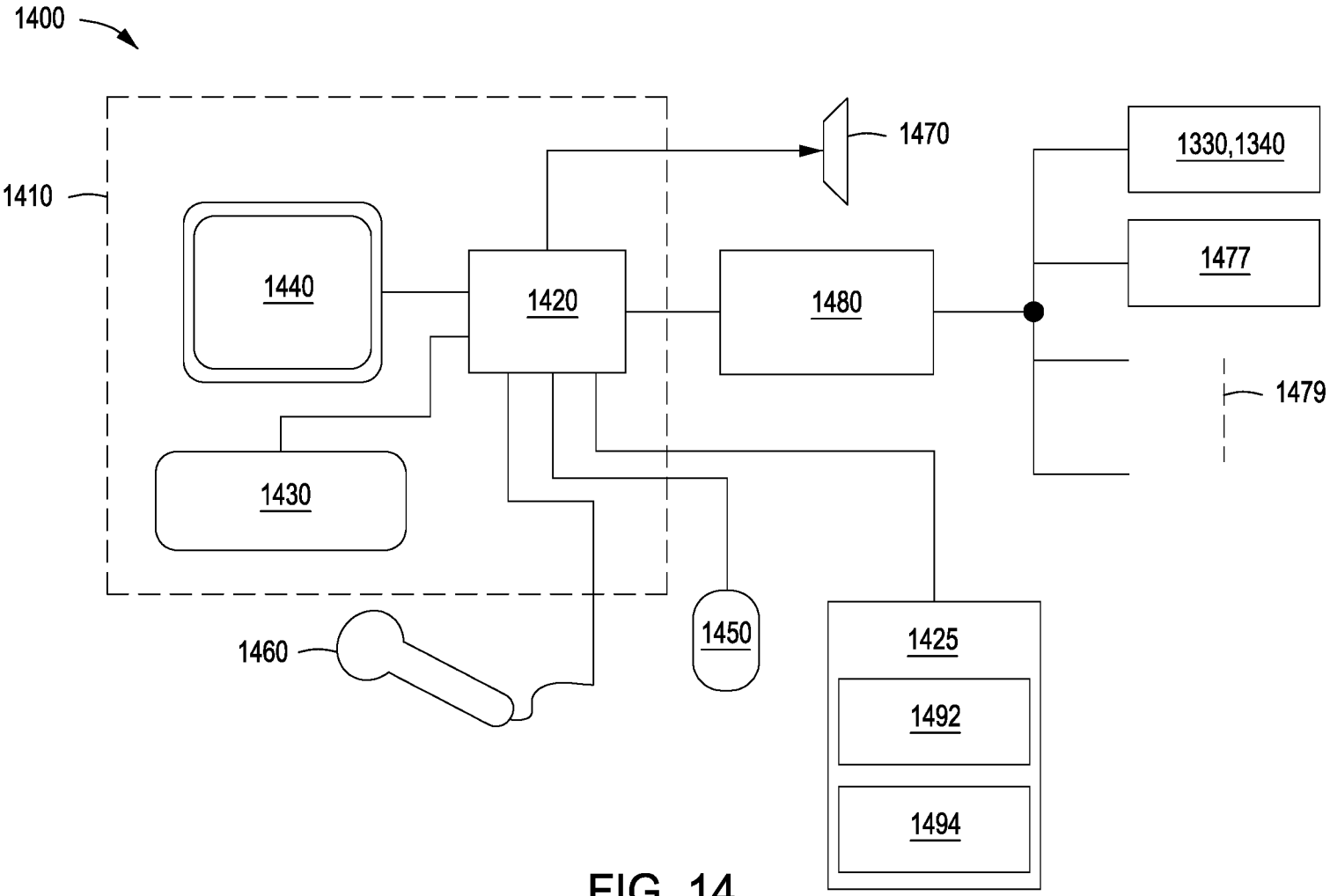
FIG. 14 depicts a control system for performing autonomous removal and installation operations of the kill line assembly and the choke line assembly, according to one or more embodiments provided herein.

FIG. 14 depicts a control system for performing autonomous removal and installation operations of the kill line assembly and the choke line assembly, according to one or more embodiments. The control system 1400 can include one or more computers 1410 that can include one or more central processing units 1420, one or more input devices, touch actuation buttons, or keyboards 1430, and one or more output devices 1440 on which a software application can be executed. The one or more touch actuation panels can include a panel having mechanically actuated buttons for sending signals to perform certain operations such as opening or closing a connector or moving an assembly. The one or more computers 1410 can also include one or more memories 1425 as well as additional input and output devices, for example a mouse 1450, one or more microphones 1460, and one or more speakers 1470. The mouse 1450, the one or more microphones 1460, and/or the one or more speakers 1470 can be used for, among other purposes, universal access and voice recognition or commanding. The one or more output devices 1440 can be touch-sensitive to operate as an input device as well as a display device.

The one or more computers 1410 can interface with database 1477, kill line assembly 1330, choke line assembly 1340, other databases and/or other processors 1479, or the Internet via the interface 1480. It should be understood that the term "interface" does not indicate a limitation to interfaces that use only Ethernet connections and refers to all possible external interfaces, wired or wireless. It should also be understood that database 1477, kill line assembly 1330, choke line assembly 1340, and/or other databases and/or other processors 1479 are not limited to interfacing with the one or more computers 1410 using network interface 1480 and can interface with one or more computers 1410 in any means sufficient to create a communications path between the one or more computers 1410 and database 1477, kill line assembly 1330, choke line assembly 1340, and/or other databases and/or other processors 1479. For example, in one or more embodiments, database 1477 can interface with one or more computers 1410 via a USB interface while kill line assembly 1330, choke line assembly 1340 can interface via some other high-speed data bus without using the network interface 1480. The one or more computers 1410, the kill line assembly 1330, choke line assembly 1340, and the other processors 1479 can be integrated into a multiprocessor distributed system.

It should be understood that even though the one or more computers 1410 is shown in FIG. 14 as a platform on which the methods discussed and described herein can be performed, the methods discussed and described herein could be performed on any platform. For example, the many and varied embodiments discussed and described herein can be used on any device that has computing capability. For example, the computing capability can include the capability to access communications bus protocols such that the user can interact with the many and varied computers 1410, the kill line assembly 1330, choke line assembly 1340, and/or other databases and processors 1479 that can be distributed or otherwise assembled. These devices can include, but are not limited to, supercomputers, arrayed server networks, arrayed memory networks, arrayed computer networks, distributed server networks, distributed memory networks, distributed computer networks, desktop personal computers (PCs), tablet PCs, hand held PCs, laptops, cellular phones, hand held music players, or any other device or system having computing capabilities.

Programs can be stored in the one or more memories 1425 and the one or more central processing units 1420 can work in concert with at least the one or more memories 1425, the one or more input devices 1430, and the one or more output devices 1440 to perform tasks for the user. The one or more memories 1425 can include any number and combination of memory devices, without limitation, as is currently available or can become available in the art. In one or more embodiments, memory devices can include without limitation, and for illustrative purposes only: database 1477, other databases and/or processors 1479, hard drives, disk drives, random access memory, read only memory, electronically erasable programmable read only memory, flash memory, thumb drive memory, and any other memory device. Those skilled in the art are familiar with the many variations that can be employed using memory devices and no limitations should be imposed on the embodiments herein due to memory device configurations and/or algorithm prosecution techniques.

The one or more memories 1425 can store an operating system (OS) 1492, and a kill and choke line assembly operations agent 1494. The operating system 1492 can facilitate control and execution of software using the one or more central processing units 1420. Any available operating system can be used in this manner including WINDOWS™, LINUX™, Apple OS™, UNIX™, and the like.

The one or more central processing units 1420 can execute either from a user request or automatically. In one or more embodiments, the one or more central processing units 1420 can execute the kill and choke line assembly operations agent 1494 when a user requests, among other requests, to move and/or operate one or more kill line assemblies and one or more choke line assemblies. The kill and choke line assembly operations agent 1494 can control actuation of connectors of the kill line assembly 1330 and/or the choke line assembly 1340 shown in FIG. 13 above. The kill and choke line assembly operations agent 1494 can control connection and disconnection of the kill line assembly 1330 and/or the choke line assembly 1340.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

Although the preceding description has been described herein with reference to particular means, materials, and embodiments, it is not intended to be limited to the particulars disclosed herein; rather, it extends to all functionally equivalent structures, processes, and uses, such as are within the scope of the appended claims.

What is claimed is:

1. A choke manifold for drilling and producing a surface wellbore, comprising:

a choke line;

a first pulsation dampener in fluid communication with the choke line; and a first choke valve in fluid communication with the first pulsation dampener, wherein the first pulsation dampener is a flow through pulsation dampener comprising an inlet configured to receive a fluid from the choke line and an outlet configured to output the fluid toward the first choke valve.

2. The choke manifold of claim 1, further comprising one or more second choke valves in fluid communication with the first pulsation dampener.

3. The choke manifold of claim 2, further comprising one or more second pulsation dampeners in fluid communication with the one or more second choke valves.

4. The choke manifold of claim 3, further comprising one or more buffer chambers in fluid communication with the one or more second choke valves, wherein a de-surge pipe is disposed within each of the one or more buffer chambers.

5. The choke manifold of claim 4, wherein each of the one or more buffer chambers comprises an annular wall that defines an internal volume, an inlet to receive the fluid into the internal volume, an outlet to output the fluid from the internal volume, and the de-surge pipe is disposed within the internal volume.

6. The choke manifold of claim 5, wherein the de-surge pipe comprises a flexible pipe that extends from a first end portion of the buffer chamber to a second end portion of the buffer chamber.

7. The choke manifold of claim 1, wherein the first pulsation dampener comprises a metal bellow.

8. The choke manifold of claim 1, wherein a respective central axis of the inlet is transverse to a respective central axis of the outlet.

9. The choke manifold of claim 1, wherein the choke line is configured to deliver the fluid from a wellhead stack to the inlet of the first pulsation dampener.

10. The choke manifold of claim 1, comprising a diverter positioned between the first pulsation dampener and the first choke valve.

11. The choke manifold of claim 10, wherein the diverter comprises a diverter inlet that is configured to receive the fluid from the outlet, a first diverter outlet that is configured to output a first portion of the fluid toward the first choke valve, and a second diverter outlet that is configured to output a second portion of the fluid toward a second choke valve.

12. The choke manifold of claim 11, wherein a first pipe of the choke manifold fluidly couples the first choke valve to a first inlet of a buffer chamber and a second pipe of the choke manifold fluidly couples the second choke valve to a second inlet of the buffer chamber.

13. The choke manifold of claim 12, wherein the buffer chamber comprises a de-surge pipe positioned within an internal volume of the buffer chamber, and the fluid is configured to flow through the internal volume and about the de-surge pipe within the buffer chamber.

14. The choke manifold of claim 12, wherein a second pulsation dampener is positioned at a first outlet of the buffer chamber and a third pulsation dampener is positioned at a second outlet of the buffer chamber.

15. The choke manifold of claim 1, wherein a second choke valve is positioned along the choke line upstream of the first pulsation dampener.

* * * * *